US008985405B2

(12) United States Patent
Wanbaugh

(10) Patent No.: US 8,985,405 B2
(45) Date of Patent: Mar. 24, 2015

(54) BOTTLE AND VALVE FITMENT FOR CONTAINERS

(75) Inventor: Linn D. Wanbaugh, Blue Springs, MO (US)

(73) Assignee: MeadWestvaco Calmar, Inc., Richmond, VA (US)

( * ) Notice: Subject to any disclaimer, the term of this patent is extended or adjusted under 35 U.S.C. 154(b) by 740 days.

(21) Appl. No.: 12/163,251

(22) Filed: Jun. 27, 2008

(65) Prior Publication Data

US 2009/0001103 A1 Jan. 1, 2009

Related U.S. Application Data

(60) Provisional application No. 60/946,910, filed on Jun. 28, 2007, provisional application No. 60/968,365, filed on Aug. 28, 2007.

(51) Int. Cl.
*B65D 83/00* (2006.01)
*B05B 11/00* (2006.01)
*B65D 83/38* (2006.01)

(52) U.S. Cl.
CPC ..... *B05B 11/3049* (2013.01); *B05B 11/0008* (2013.01); *B65D 83/38* (2013.01)
USPC ..... 222/402.1; 29/592

(58) Field of Classification Search
USPC ..... 222/402.1–402.25; 29/592
See application file for complete search history.

(56) References Cited

U.S. PATENT DOCUMENTS

| | | | | | |
|---|---|---|---|---|---|
| 1,609,453 | A * | 12/1926 | Atwood | 215/272 |
| 2,723,773 | A * | 11/1955 | Greene | 215/29 |
| 2,865,525 | A * | 12/1958 | Satz | 215/272 |
| 3,161,330 | A * | 12/1964 | Sagarin et al. | 222/402.24 |
| 3,799,392 | A * | 3/1974 | Richards | 220/326 |
| 3,863,798 | A * | 2/1975 | Kurihara et al. | 215/301 |
| 4,251,003 | A * | 2/1981 | Bodenmann | 215/254 |
| 4,773,553 | A * | 9/1988 | Van Brocklin | 215/272 |
| 5,209,362 | A * | 5/1993 | Lutzker | 215/225 |
| 5,299,703 | A * | 4/1994 | Cater | 215/274 |
| 5,314,084 | A * | 5/1994 | Folta et al. | 215/249 |
| 5,326,002 | A * | 7/1994 | Dubini | 222/402.1 |
| 5,348,174 | A * | 9/1994 | Velicka | 215/277 |
| 5,762,238 | A * | 6/1998 | Liang | 222/321.9 |
| 5,772,080 | A * | 6/1998 | de Pous et al. | 222/321.7 |
| 5,890,610 | A * | 4/1999 | Jansen et al. | 215/253 |
| 5,941,428 | A * | 8/1999 | Behar et al. | 222/321.7 |
| 6,253,941 | B1 * | 7/2001 | VanBrocklin et al. | 215/274 |
| 6,409,049 | B1 * | 6/2002 | de Pous et al. | 222/153.09 |
| 6,776,311 | B2 * | 8/2004 | Ackermann | 222/321.7 |
| 7,007,523 | B2 * | 3/2006 | Belden, Jr. | 70/57.1 |
| 7,845,505 | B2 * | 12/2010 | Hamamoto et al. | 215/277 |
| RE42,553 | E * | 7/2011 | de Pous et al. | 222/153.09 |
| 2001/0054624 | A1 * | 12/2001 | Jourdin et al. | 222/321.7 |

* cited by examiner

*Primary Examiner* — Donnell Long
(74) *Attorney, Agent, or Firm* — MeadWestvaco Intellectual Property Group

(57) ABSTRACT

A snap fitment system for attaching a closure such as a valve body to a container may include one or more fingers attached to the valve body and held in a securing position about the container by a retaining ring.

9 Claims, 9 Drawing Sheets

BOTTLE AND VALVE FITMENT FOR CONTAINERS

CROSS-REFERENCE TO RELATED APPLICATIONS

This application claims the benefit of U.S. Provisional Application No. 60/946,910, entitled "BOTTLE AND CAP FITMENT AND METHODS OF USING THE SAME," filed Jun. 28, 2007, and U.S. Provisional Application No. 60/968,365, entitled "BOTTLE AND CAP FITMENT AND METHODS OF USING THE SAME," filed Aug. 28, 2007, and incorporates each herein by reference in their entirety.

BACKGROUND OF THE INVENTION

1. Field of the Invention

Embodiments of the invention relate to devices and mechanisms for attaching a closure, pump, trigger, valve, or other device to a bottle and in particular, mechanisms and methods for attaching closures, pumps, triggers, or other devices to pressurized bottles.

2. State of the Art

Pressurized bottles and containers are used in many different industries. One of the most widely known uses of pressurized bottles in commercial markets includes aerosol bottles and containers. Aerosol bottles and containers generally hold pressurized gases, gases and liquids, or liquids.

Conventional aerosol bottles are constructed of one or more metals and are typically found in a cylindrical shape which may assist in supporting the pressure inside the aerosol bottle. Closure fitments, such as pumps, valves, triggers, or other devices may be attached to an aerosol bottle to close the bottle and to provide access to the contents of the bottle. The closure fitments are typically sealed to the rim or neck of the aerosol bottle such that they cannot be easily removed.

Increasing costs of metal and difficulties in recycling pressurized metal containers have made it desirable to develop other types of containers, such as plastic containers, and closures systems for such containers. Therefore, it would be advantageous to develop a closure system that may be used with plastic bottles or containers and especially with plastic bottles or containers that may be pressurized or used for aerosol delivery systems.

BRIEF SUMMARY OF THE INVENTION

According to certain embodiments of the invention, a valve system for a container may include a valve cup holding a valve system wherein the valve cup is configured to fit over the opening of a container and support the valve system in the container opening. A retaining ring may be fitted over the valve cup and press fitted to the valve cup to collapse one or more fingers extending radialy from the valve cup about the container. The positioning of the retaining ring about the valve cup may secure the valve cup to the container or secure the one or more fingers about an opening in the container or a flange around the opening of the container. The valve cup and retaining ring may be made of plastic, metal, or other material and the container may be plastic, metal, or other material.

According to other embodiments of the invention, an aerosol disbursement system may include a container having an opening therein and a flange about the opening. A valve cup may be fitted to the container opening to support a valve in the container opening. The valve cup may include one or more fingers which may extend radialy from the valve cup. A retaining ring made of plastic, metal, or other material may be fitted over the valve cup and pressed over the one or more fingers to secure the valve cup to the container.

According to still other embodiments of the invention, a method for securing a valve to a container may include providing a container having an opening and a container flange about the opening of the container. A snap fitment system comprising a valve cup having one or more fingers extending in a radial direction therefrom and a retaining ring may support a valve and may be situated over the opening of the container such that the valve is in the opening of the container. The retaining ring may be pressed over the valve cup and the one or more fingers to secure the one or more fingers around the container flange such that the valve is secured to the container.

According to embodiments of the invention, the snap fitment systems, valve cups, valves, and retaining rings may be made of plastic, metal or other materials. In some embodiments, the valve cup and retaining ring may be molded from plastic or resin materials. In other embodiments of the invention, the containers may be plastic, metal, or other material.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to embodiments of the invention, a snap-fitment system may be used to attach a closure, pump, trigger, or other device to a pressurized bottle. While various embodiments of the invention are described with respect to a closure being attached to a bottle or container, it is understood that a closure may include, but is not limited to, pumps, triggers, distribution means, valves, or other devices.

Figure 1:
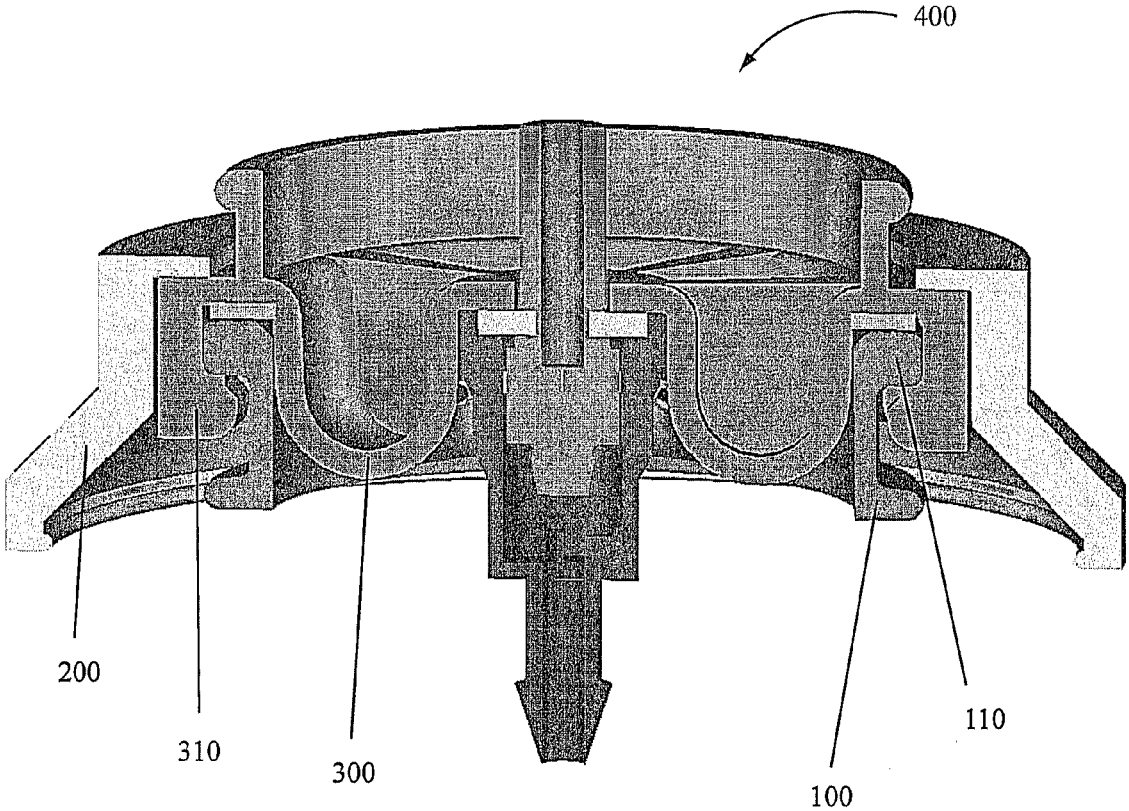
FIG. 1 illustrates a snap fitment system according to embodiments of the invention attached about a container.

According to embodiments of the invention, a valve cup 300 may include one or more fingers 310 which may be used to attach the valve cup 300 to a container 100. As illustrated in FIG. 1, one or more fingers 310 of a valve cup 300 may be compressed by a retaining ring 200 about a container flange 110. The retaining ring 200 may hold the fingers 310 about the container flange 110 such that pressure in the container 100 may be maintained or so that the valve cup 300 is secured to the container 100.

Figure 2:
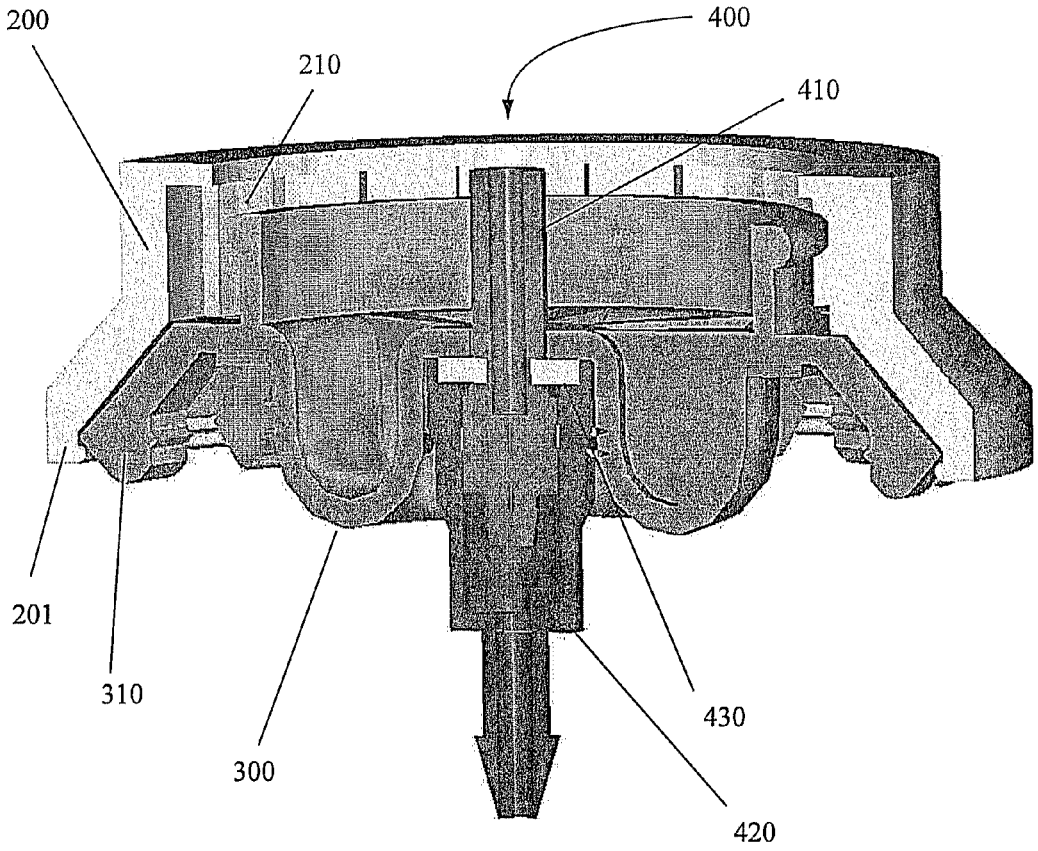
FIG. 2 illustrates a snap fitment system according to various embodiments of the invention.
Figure 3:
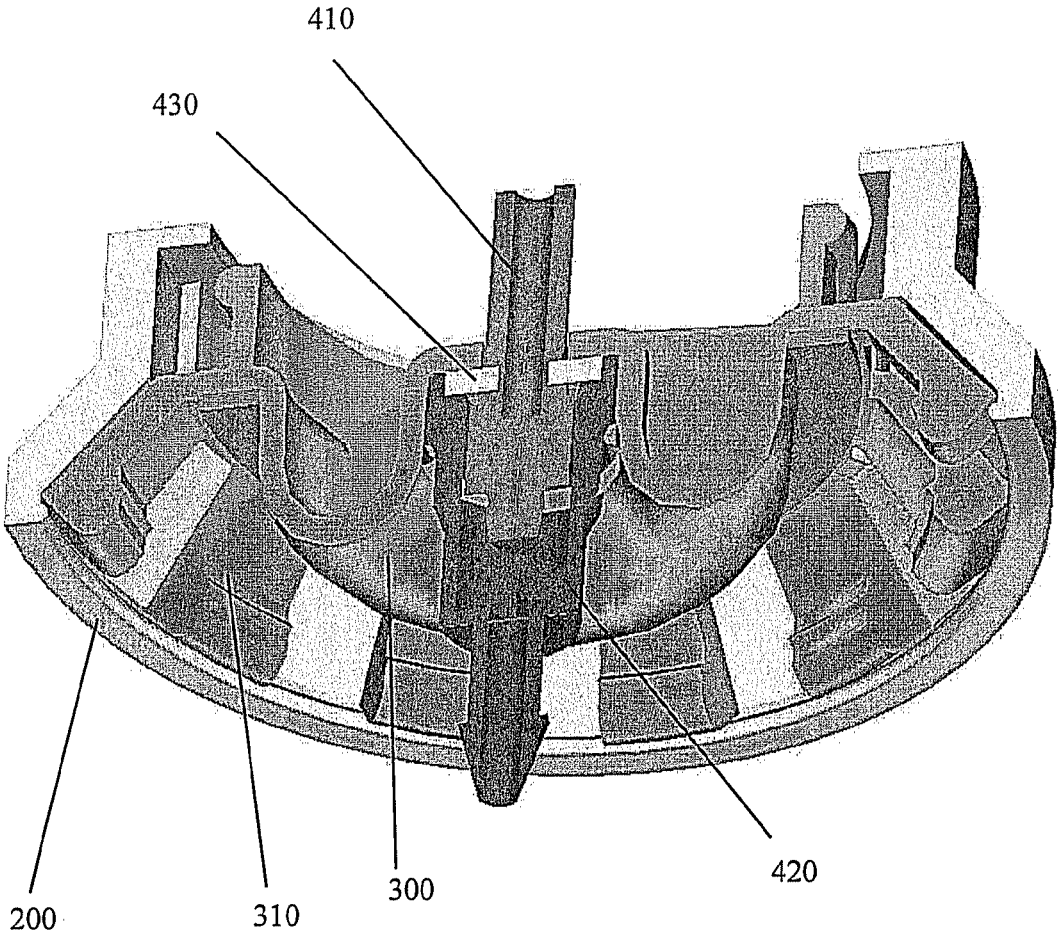
FIG. 3 illustrates an alternate cross-sectional view of a snap fitment system according to embodiments of the invention.

According to certain embodiments of the invention a snap-fitment system may include a valve cup 300, a valve system 400, and a retaining ring 200 as illustrated in FIGS. 2 and 3.

The valve cup 300 may include one or more fingers 310. A retaining ring 200 may encompass at least a portion of the fingers 310 of the valve cup 300. As illustrated in FIG. 2, the retaining ring 200 may also include one or more lips 201 which may be snapped about one or more fingers 310 such that the retaining ring 200 and the valve cup 300 may be distributed as a single unit. The retaining ring 200 may include a cylindrical portion and a flared portion wherein the flared portion fits about the fingers 310 of the valve cup 300 as in the position illustrated in FIG. 2.

The valve system 400 illustrated in FIG. 2 may include a valve stem 410 positioned in a valve housing 420. A valve gasket 430 may be positioned between a portion of the valve housing 420 and an underside of the valve cup 300 as conventionally known. The valve cup 300 may also include one or more lips, platforms, or other projections which may be used to hold the valve system 400 in a position relative to the valve cup 300 as illustrated in FIG. 2.

Figure 4:
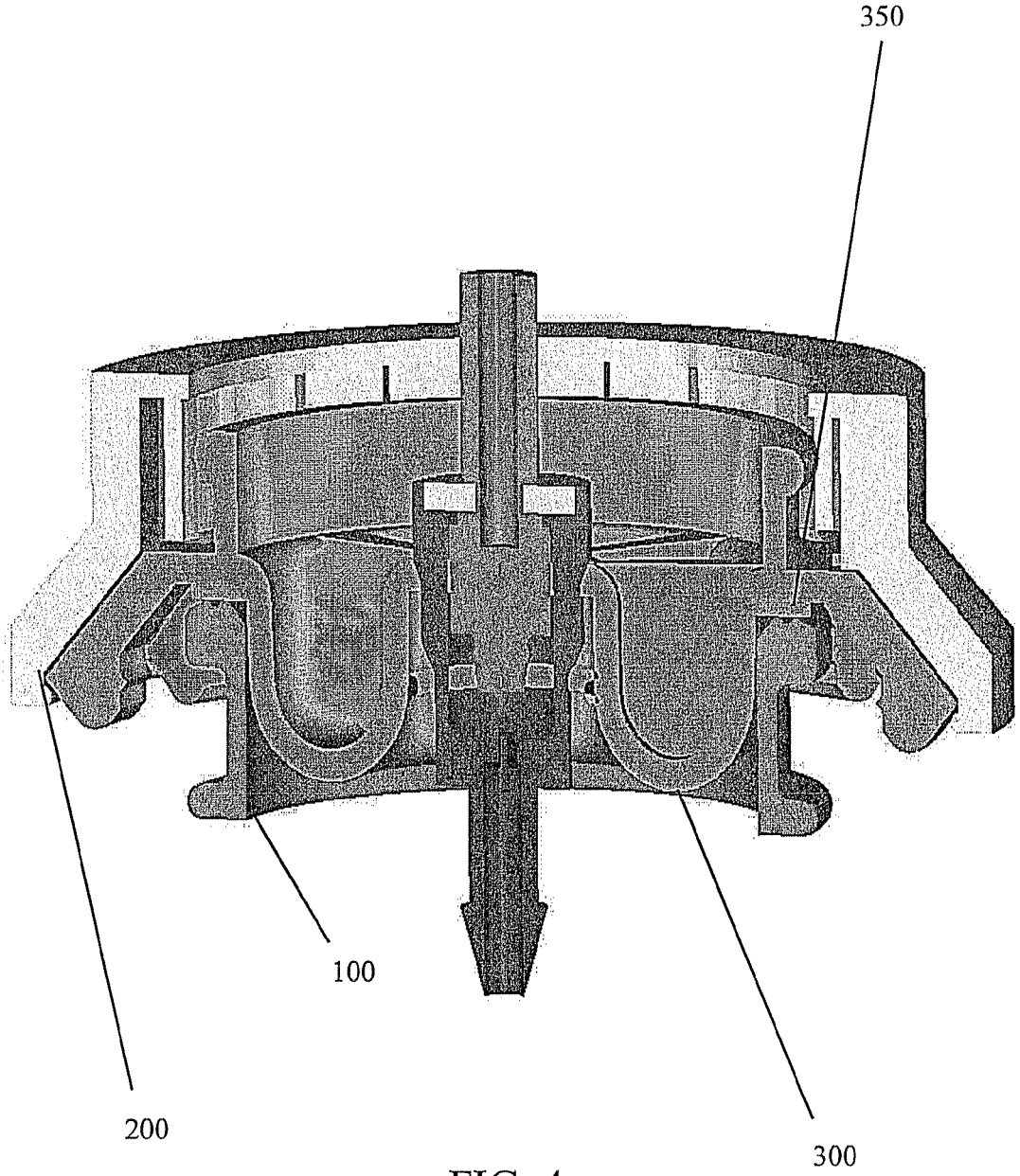
FIG. 4 illustrates a snap fitment system and container in position for attaching the snap fitment system to the container.

The snap fitment system illustrated in FIG. 2 may be attached to a container 100 to form a seal between the snap fitment system and the container 100. For example, the snap fitment system illustrated in FIG. 2 may be placed over a container 100 such that the valve cup 300 rests over an opening in the container 100 as illustrated in FIG. 4. A valve cup gasket 350 may be positioned between an underside of the valve cup 300 and the flange 110 of the container. The retaining ring 200 may be forced in a direction towards the container 100, causing the fingers 310 of the valve cup 300 to collapse about the flange 110 of the container 100. As the force on the retaining ring 200 is applied, the fingers 310 of the valve cup 300 wrap around the flange 110 of the container 100 securing the snap fitment system to the container 100 as illustrated in FIG. 1.

Figure 5:
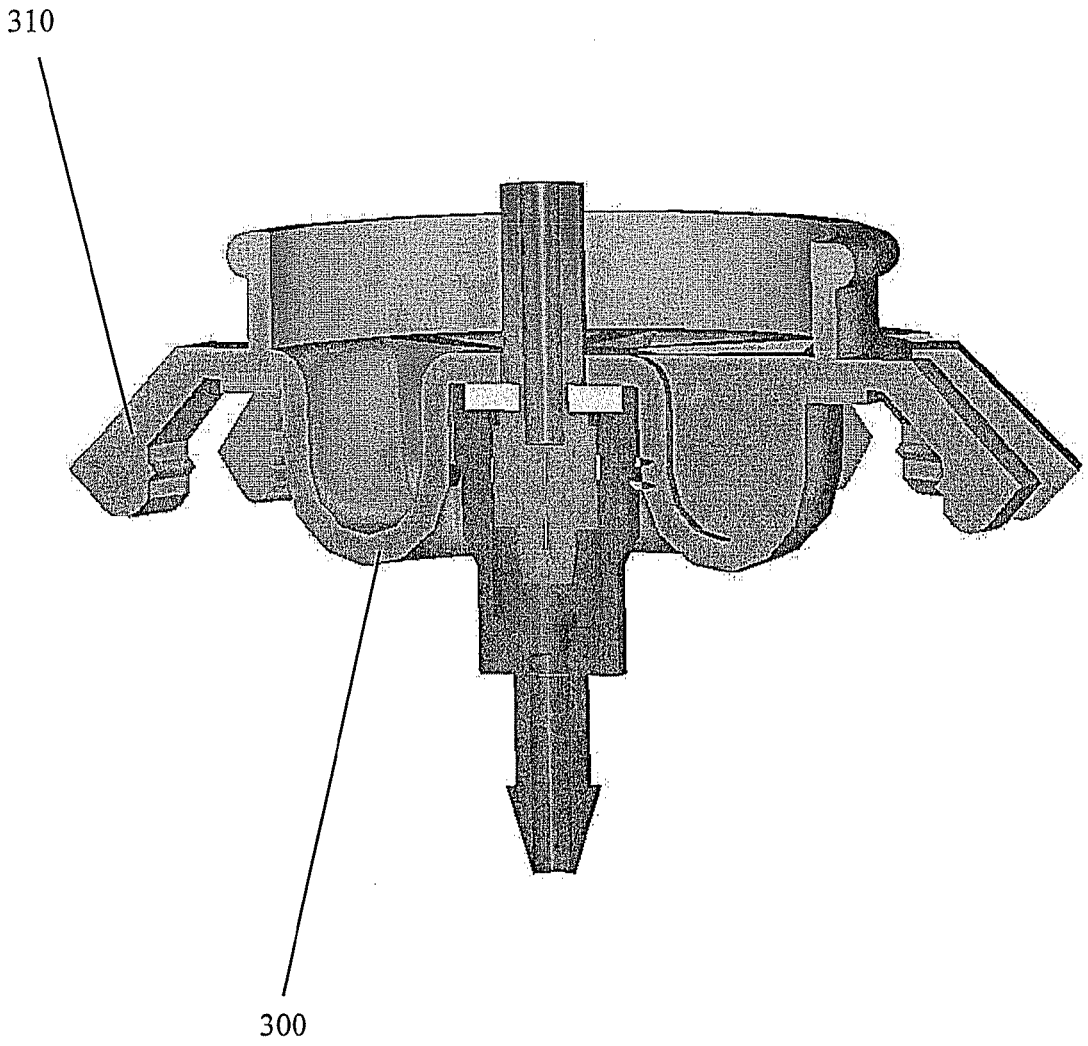
FIG. 5 illustrates a valve cup and valve system according to embodiments of the invention.

According to certain embodiments of the invention, a valve cup 300 may include two or more fingers 310 as illustrated in FIG. 5. For example, the valve cup 300 may include two fingers 310, three fingers 310, four fingers 310 or more. The fingers 310 may be symmetrically arranged about the valve cup 300 or may be asymmetrical. Spacing between the fingers 310 may be consistent or inconsistent. Any number of fingers 310 may include projections, bumps, or other features at the end of the fingers 310 such that such projections, bumps, or other features may wrap around or underneath a container flange 310. The projections, bumps, or other features may be configured to help clasp or otherwise hold the snap fitment system to a container 100.

According to some embodiments of the invention, the retaining ring 200 may include one or more crush ribs 210 as illustrated in FIG. 2. The crush ribs 210 may deform when the retaining ring 200 is forced about the fingers 310 of the valve cup 300. Deformation of the crush ribs 210 may hold the retaining ring 200 in place once it has secured the fingers 310 about a flange 110 of a container 100. In other embodiments, the retaining ring 200 may include snap fitments in the place of, or in addition to, crush ribs 210. As a retaining ring 200 is pushed down over a valve cup 300 and the fingers 310, the snap fitments may pop into the spaces between the fingers 310 and may snap into place with a portion of the valve cup 300 thereby preventing the retaining ring 200 from backing off of the position about the fingers 310 of the valve cup 300.

The valve cup 300 and retaining ring 200 of various embodiments of the invention may be made of any suitable material, including, but not limited to, plastic materials, metals, composites, or other materials. Similarly, the containers 100 to which the snap fitment systems according to embodiments of the invention may include plastic containers, glass containers, metal containers, or other containers.

Figure 6:
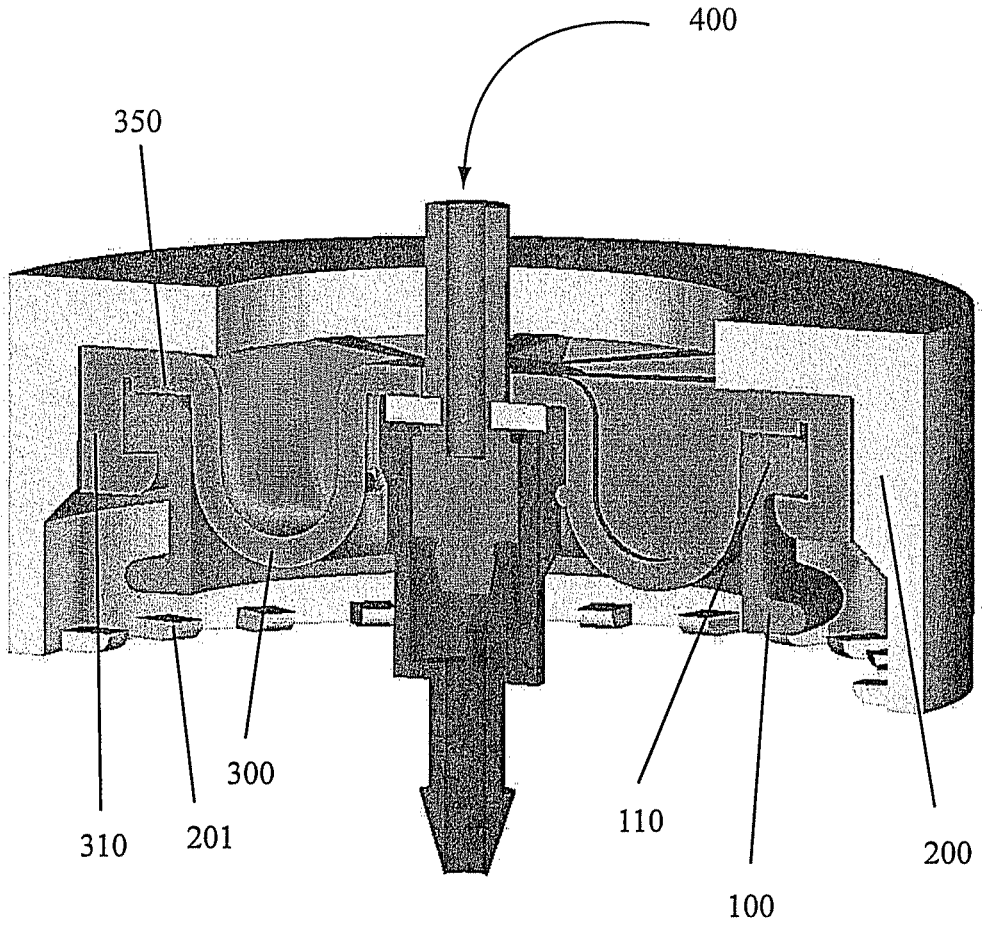
FIG. 6 illustrates an alternate embodiment of a snap fitment system according to embodiments of the invention.

FIGS. 6 through 10 illustrate alternate embodiments of a snap fitment system according to embodiments of the invention. As illustrated in FIG. 6, the snap fitment system may include a valve cup 300 having one or more fingers 310 which may be positioned around or on a container 100. The container 100 may include one or more container flanges 110 mated with one or more fingers 310 when a retaining ring 200 is positioned over or about the valve cup 300. The valve system 400 may include any conventional valve system. A gasket may also be located between the container 100 and the valve cup 300.

Figure 7:
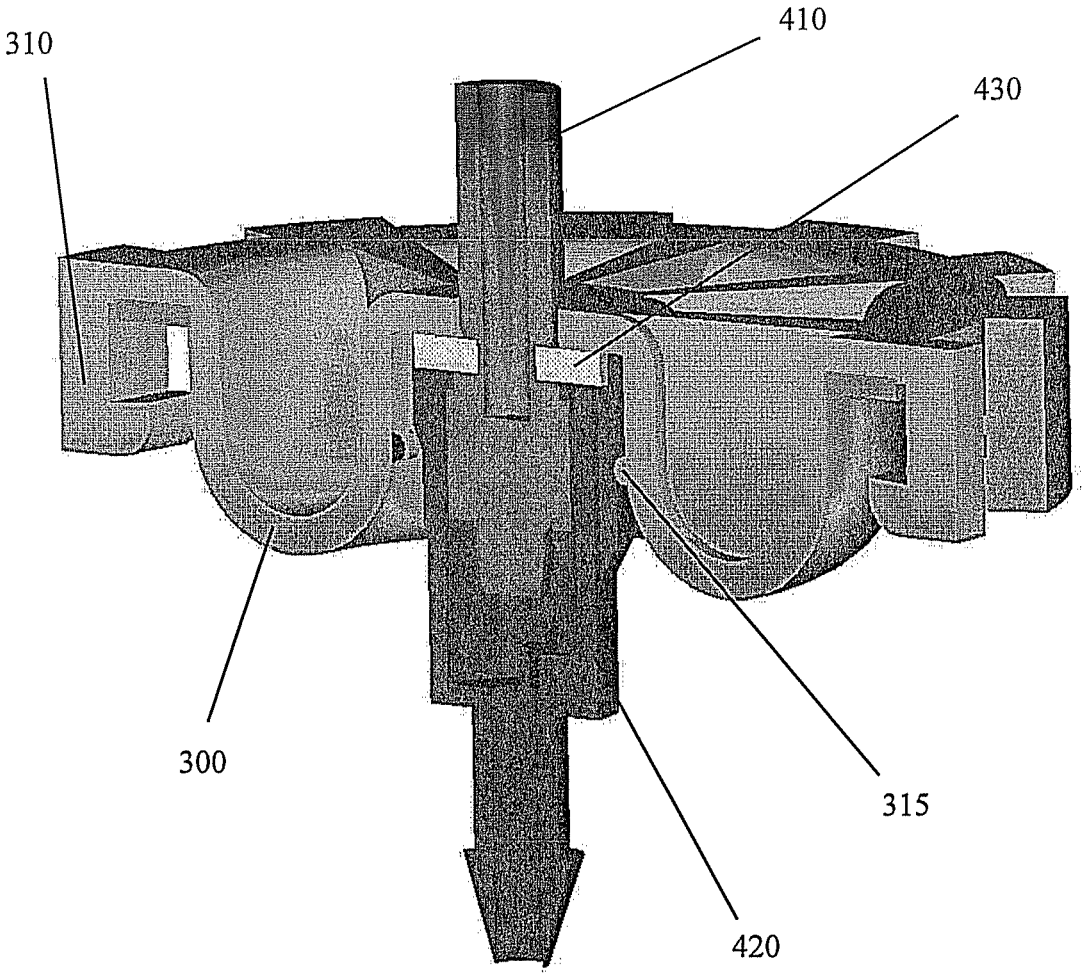
FIGS. 7 through 10 illustrate various views of the snap fitment system illustrated in FIG. 6.

FIG. 7 illustrates a valve system 400 incorporated or fitted into a valve cup 300 according to embodiments of the invention. The valve housing 420 may be held in place with respect to the valve cup 300 by one or more valve housing connectors 315 in the valve cup 300. The valve housing connectors 315 may include, but are not limited to, detents, indentations, snap fitments, bayonets, threaded systems, or other devices for retaining a valve housing 420 in a valve cup 300.

Figure 8:
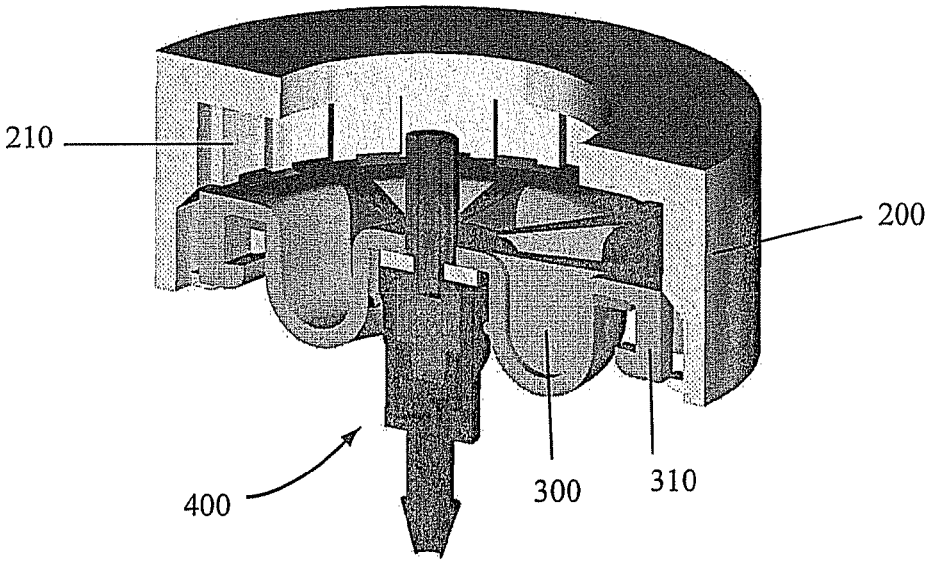
Figure 9:
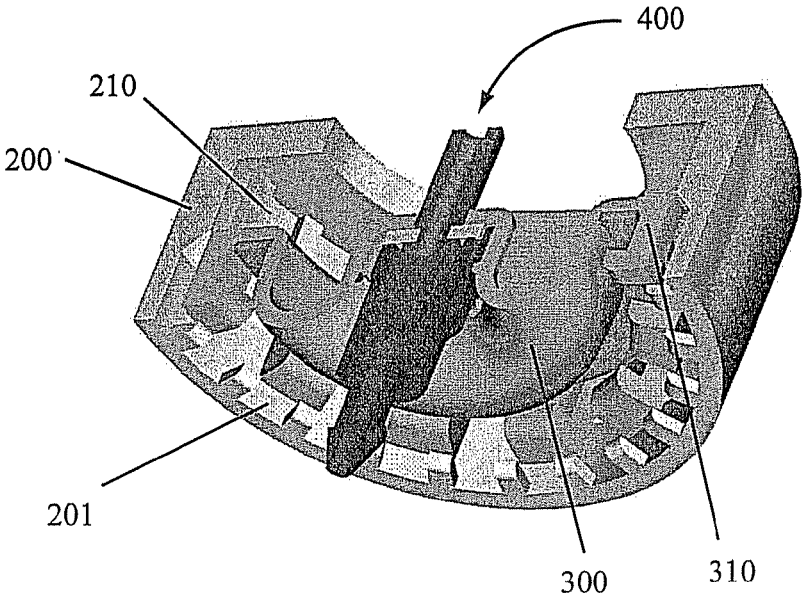

A retaining ring 200 may be incorporated with the valve system 400 and valve cup 300 as illustrated in FIGS. 8 and 9. The retaining ring 200 may be fitted over a portion of the valve cup 300 and fingers 201 on the retaining ring 200 may secure the retaining ring 200 to the valve cup 300 through interference with one or more fingers 310. The valve cup 300, retaining ring 200, and valve system 400 are part of the snap fitment system that may be shipped, transported, sold, or otherwise manipulated as desired.

Figure 10:
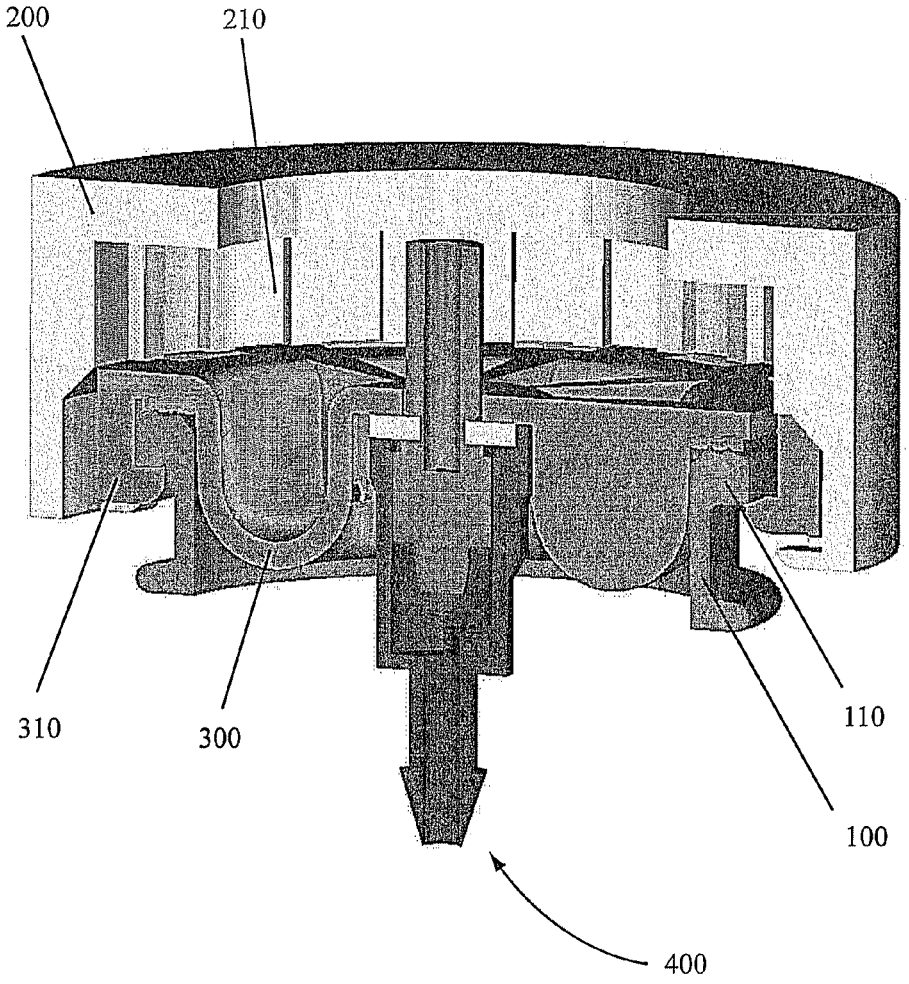

The snap fitment system illustrated in FIGS. 8 and 9 may be placed over a container opening as illustrated in FIG. 10. The fingers 310 of the valve cup 300 may be forced past one or more container flanges 110 of a container 100. When the snap fitment system is fitted onto a container 100, the retaining ring 200 may be forced downward with respect to the valve cup 300 such that the retaining ring 200 forces fingers 310 to firmly attach or mate with one or more container flanges 110 as illustrated in FIG. 6. In this manner, a valve may be attached to a container 100 as desired.

According to various embodiments of the invention, a snap fitment system may be attached to an aerosol container to provide an aerosol disbursement system. The aerosol disbursement system may be used to distribute any aerosol, including, air care formulas, hair care formulas, fragrances, or other formulas.

While particular embodiments of the invention have been described with respect to aerosol bottles and containers, it is understood that various embodiments of the invention may be adapted and used with other bottles and containers. For example, embodiments of the invention may be used to attach closures, pumps, triggers, or other devices to other pressurized containers. In addition, embodiments of the invention may be use to attach closures, pumps, triggers, or other devices to non-pressurized containers and bottles as well.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A method for securing an aerosol valve to a container, comprising:

providing an aerosol container having an opening and a container flange about the opening;

providing an assembled snap fitment system comprising:

a valve cup;

at least one valve cup finger extending radially from the valve cup;

a valve housing assembled to the valve cup;

a valve stem in the valve housing;

a retaining ring assembled with the valve cup; and at least one lip about the retaining ring, wherein the at least one lip is snapped about the at least one valve cup finger to retain the retaining ring to the valve cup;

aligning the snap fitment system on the container to position the valve housing in the container opening and the at least one valve cup finger extending radially away from the container flange; and moving the retaining ring over the at least one finger.

2. The method for securing a valve to a container of claim 1, wherein moving the retaining ring over the at least one finger comprises pressing the retaining ring over the valve cup to engage the at least one finger with the container.

3. The method for securing a valve to a container of claim 1, wherein providing a snap fitment system comprising a valve cup and a retaining ring further comprises providing a plastic valve cup and a plastic retaining ring.

4. A snap-fitment valve assembly for an aerosol container, comprising:

a plastic valve cup, comprising:

at least one finger extending radially from the valve cup; and at least one valve housing connector on the valve cup;

an aerosol valve system, comprising:

a valve housing; and a valve stem;

a plastic retaining ring, comprising:

a cylindrical portion;

a flared portion extending outward from the cylindrical portion; and at least one lip about an outer circumference of the flared portion;

wherein the aerosol valve system and plastic retaining ring are assembled with the plastic valve cup such that the at least one valve housing connector retains the valve housing to the plastic valve cup and the at least one lip of the plastic retaining ring retains that at least one finger of the plastic valve cup, prior to assembly with the aerosol container.

5. The snap-fitment valve assembly of claim 4, wherein the snap-fitment valve assembly may be distributed as a single unit.

6. The snap-fitment valve assembly of claim 4, further comprising a valve gasket positioned between the plastic valve cup and the valve housing.

7. The snap-fitment valve assembly of claim 4, wherein the at least one finger of the plastic valve cup comprises at least two fingers.

8. The snap-fitment valve assembly of claim 4, wherein the at least one finger further comprises at least one projection on an end of the at least one finger.

9. The snap-fitment valve assembly of claim 4, wherein the plastic retaining ring comprises a plurality of retaining ring snap fitments.

* * * * *